US006553630B1

(12) United States Patent
Rübenach

(10) Patent No.: US 6,553,630 B1
(45) Date of Patent: Apr. 29, 2003

(54) DEVICE FOR SETTING THE DISTANCE BETWEEN ADJOINING FIBER CLAMPING AND FIBER TRANSFER LOCATIONS IN A FIBER PROCESSING SYSTEM

(75) Inventor: Bernhard Rübenach, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/176,533

(22) Filed: Jun. 24, 2002

Related U.S. Application Data

(63) Continuation-in-part of application No. 10/119,298, filed on Apr. 10, 2002.

(30) Foreign Application Priority Data

Apr. 11, 2001 (DE) ..... 101 18 067

(51) Int. Cl.[7] ..... D01G 15/40
(52) U.S. Cl. ..... 19/105; 19/200
(58) Field of Search ..... 19/105, 98, 99, 19/100, 106 R, 112, 65 R, 65 A, 200, 202, 203, 204, 205

(56) References Cited

U.S. PATENT DOCUMENTS 4,928,355 A * 5/1990 Leifeld ..... 19/105
4,993,120 A 2/1991 Staheli ..... 19/105
5,123,145 A * 6/1992 Schelb et al. ..... 19/202
5,257,438 A * 11/1993 Faas et al. ..... 19/145.5
5,613,278 A * 3/1997 Temberg ..... 19/105
6,212,737 B1 * 4/2001 Faas ..... 19/98

FOREIGN PATENT DOCUMENTS

DE 25 52 425 B2 7/1976
DE 196 30 018 A1 1/1998
DE 199 23 418 A1 11/2000
EP 04 68 985 B1 2/1992

* cited by examiner

*Primary Examiner*—Gary L Welch
(74) *Attorney, Agent, or Firm*—Venable; Robert Kinberg; Stuart I. Smith

(57) ABSTRACT

A fiber processing system includes a first roll; a feed tray forming a feeding device with the first roll and defining a clamping location therewith for clamping and advancing fiber material; a second roll cooperating with the feeding device for taking over the fiber material therefrom at a transfer location on the second roll; a third roll cooperating with the second roll for taking over the fiber material from the second roll; and an adjusting arrangement for varying a distance between the clamping and transfer locations. The adjusting arrangement includes a pivoting device for arcuately displacing the second roll about the rotary axis of the first or the third roll; and a shifting device for displacing the feeding device toward or away from the third roll.

10 Claims, 6 Drawing Sheets

A
1
2
3
4'
4''
5
6
7
8
9
10
11'
11''
12
13
14
15
15
16₁
16₂
17
18
19
20
21
22
23
25
25
26
26
27
28a
28b
31
B
C
I
II
II
III
IV

DEVICE FOR SETTING THE DISTANCE BETWEEN ADJOINING FIBER CLAMPING AND FIBER TRANSFER LOCATIONS IN A FIBER PROCESSING SYSTEM

CROSS REFERENCE TO RELATED APPLICATIONS

This application is a continuation-in-part of application Ser. No. 10/119,298 filed Apr. 10, 2002.

This application claims the priority of German Application No. 101 18 067.5 filed Apr. 11, 2001, which is incorporated herein by reference.

BACKGROUND OF THE INVENTION

This invention relates to a device for a fiber processing machine such as a carding machine or a roller card for evening the fiber web or sliver produced thereby. The fiber processing machine may be preceded by a fiber tuft feeder which has a feed chute and further includes a feeding device composed of a feed roll and a feed tray which directly cooperate with an opening roll (such as a preliminary roll in a roller card and a licker-in in a carding machine) of the fiber processing machine. The lower end of the feed chute terminates in the region of the feed roll in such a manner that the feed roll draws the fiber material from the feed chute.

In a known device, such as disclosed in European Patent No. 468,985, a carding machine is fixedly connected with an upstream-arranged tuft feeder. The housing of the tuft feeder accommodates a feed chute which continues, without the interposition of delivery rolls, as a hopper slide, by means of which the fiber material (fiber batt) is advanced to the carding machine. The feed roll cooperates with the fixed-axis licker-in of the carding machine. Setting the distance between a clamping location defined by the cooperating feed roll and feed tray and a combing location (which is the location where the fiber material is transferred to the opening roll) is not contemplated by the prior art structure.

SUMMARY OF THE INVENTION

It is an object of the invention to provide, in a fiber processing system, an improved device of the above-outlined type with which the distance between the clamping and transfer locations may be altered in a simple manner, making possible an improved processing of the fiber material.

This object and others to become apparent as the specification progresses, are accomplished by the invention, according to which, briefly stated, the fiber processing system includes a first roll; a feed tray forming a feeding device with the first roll and defining a clamping location therewith for clamping and advancing fiber material; a second roll cooperating with the feeding device for taking over the fiber material therefrom at a transfer location on the second roll; a third roll cooperating with the second roll for taking over the fiber material from the second roll; and an adjusting arrangement for varying a distance between the clamping and transfer locations. The adjusting arrangement includes a pivoting device for arcuately displacing the second roll about the rotary axis of the first roll or the third roll; and a shifting device for displacing the feeding device toward or away from the third roll.

By virtue of the fact that, as viewed in the direction of fiber processing, the opening roll adjoining the feeding device may be swung about the axis of an immediately adjoining roll, the transfer location may be changed, whereby the distance between the clamping location and the transfer location is altered as well. Thus, a distance adjustment is feasible which is of primary importance for a gentler and more uniform feed of the fiber material. In particular, an advantageous adaptation of the distance to the properties (particularly the fiber length) of the processed fiber material is feasible by setting the distance as a function of such properties.

DESCRIPTION OF THE PREFERRED EMBODIMENTS

Figure 1:
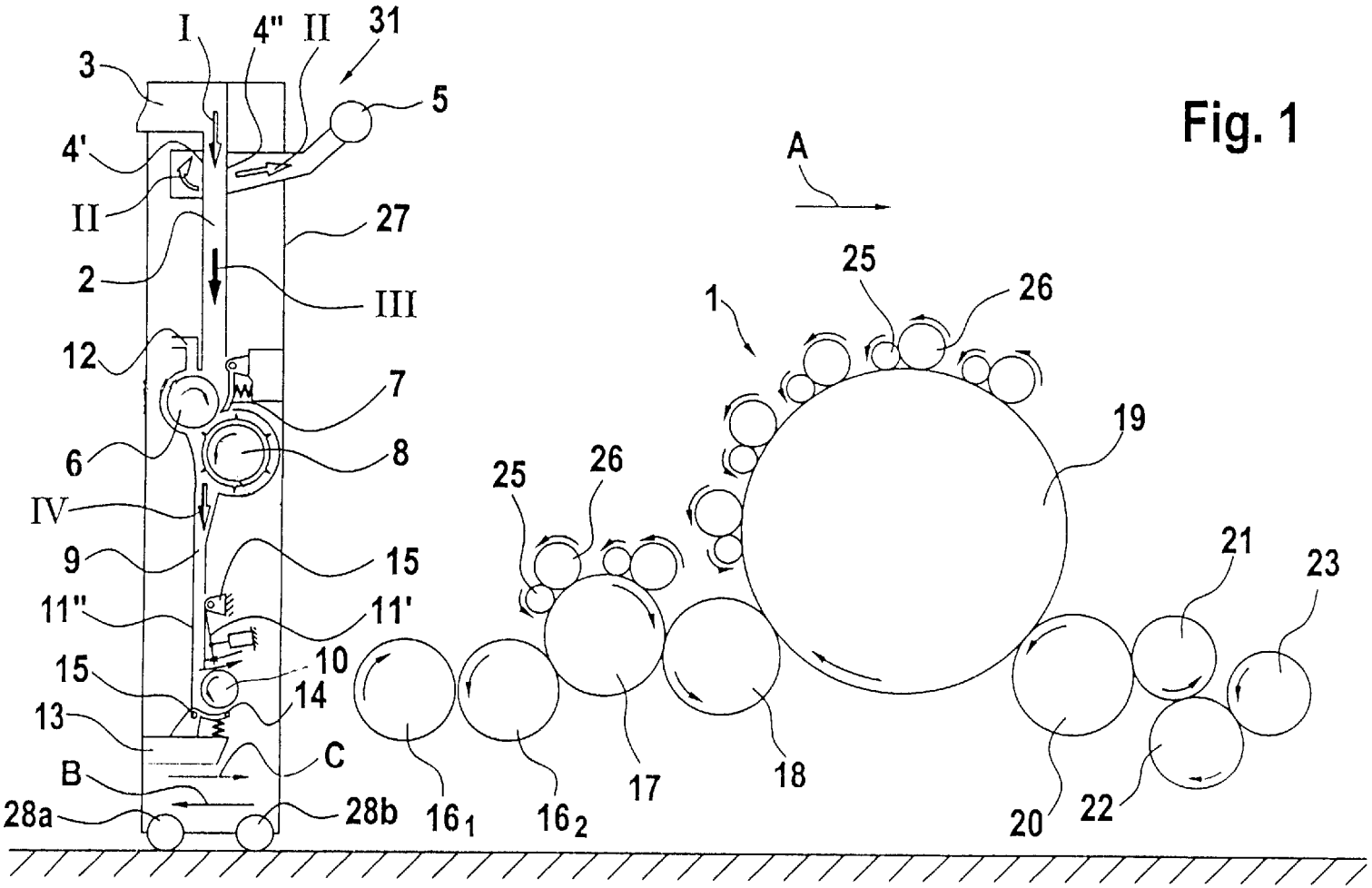
FIG. 1 is a schematic side elevational view of a roller card, preceded by a roller card feeder.

FIG. 1 shows a roller card 1 in which the processed fiber advances in the direction A. Upstream of the roller card 1—as viewed in the fiber processing direction A—a roller card feeder 31 is arranged which may be, for example, a SCANFEED model manufactured by Trützschler GmbH & Co. KG, Mönchengladbach, Germany. The feeder 31 has a housing 27 which is provided with wheels 28*a,* 28*b* for displacing the feeder 31 on the supporting floor in the direction of the arrows B, C. The feeder 31 further includes a vertical reserve chute 2 supplied from above with a flow I composed of air and finely opened fiber, advanced in a supply and distributor conduit 3. In the upper region of the reserve chute 2 air outlet openings 4', 4" are provided through which the conveying air stream II enters into a suction device 5 after the fiber tufts III have been separated from the stream II. A slowly rotating delivery roll 6 at the lower end of the reserve chute 2 advances the fiber material in cooperation with a feed tray 7 from the reserve chute 2 to a rapidly rotating opening roll 8 which is provided with a pin or sawtooth clothing. A circumferential portion of the opening roll 8 borders the entrance at the upper end of a downwardly extending feed chute 9 into which the opening roll 8 advances the fiber material. At the lower, outlet end of the feed chute 9 a slowly rotating delivery roll 10 is provided which, in cooperation with a feed tray 14, advances the fiber material to the roller card 1.

The walls forming the feed chute 9 are, in the region of their lower portion and up to a certain height, provided with air outlet openings 11', 11". For uniformly densifying and maintaining constant the discharged fiber quantities, at the upper, entrance end the feed chute 9 communicates with an air passage 12 coupled to a blower. As a result, the fiber material is exposed to an air stream at the delivery roll 6 from the air passage 12, so that an air/fiber tuft mixture IV advances in the feed chute 9. The air is withdrawn at the lower part of the feed chute 9 through the air outlet openings 11', 11". The fiber material is continuously introduced into the feed chute 9 at a predetermined flow rate by the feed roll 6 and the opening roll 8, and the fiber material is discharged at the same flow rate from the feed chute 9 by the delivery roll 10 and the feed tray 14. The feed tray 14 is composed of a series of individual feed tray elements rotatable about pivot 15 of a tray support structure 13 which, in turn, is mounted on the inside of the housing 27 of the feeder 31. The delivery roll 10 and the feed tray 14 of the feeder 31 form a feeding device for supplying the fiber material (fiber batt) directly to the roller card 1. For this purpose the feeder 31 is, from its position shown in FIG. 1, rolled to the immediate vicinity of the roller card 1.

The feeding device 10, 14 is followed in the working direction A by a first preliminary roll $\mathbf{16}_1$, a second preliminary roll $\mathbf{16}_2$, a preliminary cylinder 17 (licker-in), a transfer roll 18, a main cylinder 19, a doffer 20 and a stripping roll 21. With the licker-in 17 two roll pairs and with the main cylinder 19 six roll pairs cooperate, each being formed of a working roll 25 and a reversing roll 26. The stripping roll 21 is adjoined by and is cooperating with two calender rolls 22, 23. All the above-noted rolls of the roller card 1 rotate at high circumferential velocities.

Figure 2:
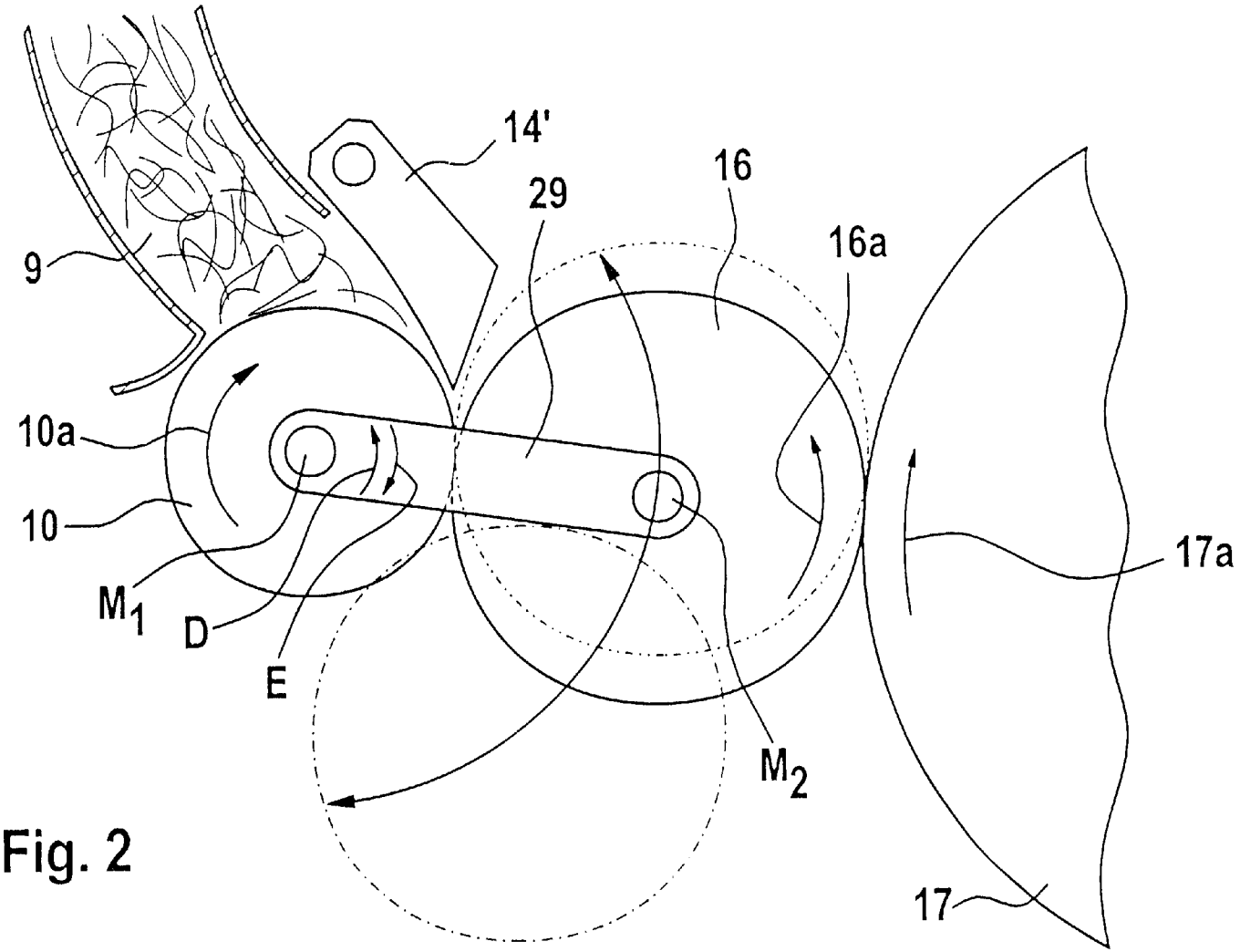
FIG. 2 is a schematic side elevational view of a preferred embodiment of the invention in which the opening roll, cooperating with the feed roll, is pivotal about the rotary axis of the feed roll.

Turning to FIG. 2, the feed tray 14' is positioned above the feed roll 10 which rotates in the direction 10*a*. The feed roll 10 is followed by an opening roll 16 rotating in the direction 16*a*. These two directions of rotation are opposite to one another so that along the cooperating circumferential regions of the two rolls the latter move in the same direction. In this arrangement the opening roll 16 of FIG. 2 functions as the roll $\mathbf{16}_1$ of FIG. 1 and directly transfers fiber material to the preliminary drum 17, whereby the second opening roll $\mathbf{16}_2$ of FIG. 1 is advantageously dispensed with.

The preliminary roll 16 is arranged for pivotal adjustment about the rotary axis $M_1$ of the feed roll 10. For this purpose, one end of a lever 29 is mounted on the shaft of the feed roll 10 and the opposite end of the lever 29 is mounted on the shaft or supporting bracket of the preliminary roll 16. By means of this construction the lever 29 may pivot in the direction of the arrows D, E about the axis $M_1$ of the feed roll 10, and thus likewise, the preliminary roll 16 may swing about the axis $M_1$. In this manner the distance between the clamping location (that is, the smallest distance between the feed roll 10 and the feed tray 14') and the transfer location (that is, the smallest distance between the feed roll 10 and the preliminary roll 16) is changed. During the arcuate displacement of the axis $M_2$ of the preliminary roll 16 about the axis $M_1$ of the feed roll 10, the distance between the non-illustrated clothings of the feed roll 10 and the preliminary roll 16 remains constant. In this construction the preliminary roll 16 is a structural component of the roller card feeder 31.

Figure 3A:
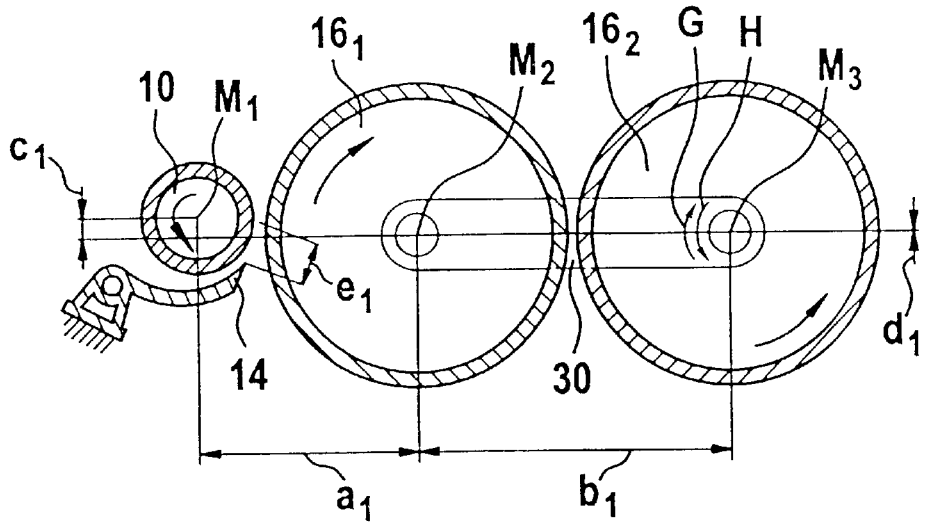
FIGS. 3*a* and 3*b* are schematic side elevational views, in two different operational positions, of a further preferred embodiment of the invention in which the opening roll, cooperating with the feed roll, is pivotal about the rotary axis of an immediately consecutive opening roll.
Figure 3B:
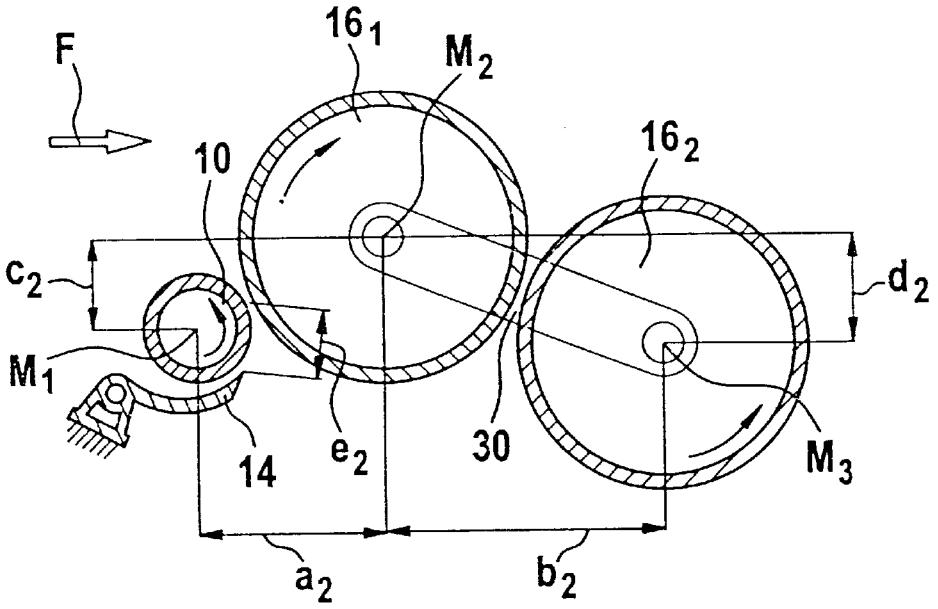

Turning to the embodiment shown in FIGS. 3*a* and 3*b*, the feeding device (composed of the feed roll 10 and the feed tray 14) of the roller card feeder, as well as the preliminary rolls $\mathbf{16}_1$ and $\mathbf{16}_2$ of the roller card are arranged in series. In this embodiment the preliminary roll $\mathbf{16}_1$ is arranged to swing about the axis $M_3$ of the subsequent preliminary roll $\mathbf{16}_2$. For this purpose the two rolls $\mathbf{16}_1$ and $\mathbf{16}_2$ are coupled to one another by a lever 30 in a manner similar to the connection between rolls 10 and 16 by the lever 29 of the FIG. 2 embodiment. The lever 30 is pivotal in the direction of the arrows G, H about the axis $M_3$. In this manner, the preliminary roll $\mathbf{16}_1$ may swing about the rotary axis $M_3$ of the preliminary roll $\mathbf{16}_2$. By rotation in the direction of the arrow G, the distance $e_1$ according to FIG. 3*a* is increased to $e_2$ according to FIG. 3*b*, that is, the distance between the clamping location defined by the components 10 and 14 and the transfer location between the components 10 and $\mathbf{16}_1$ is adjustable. Further, a change of at least some of the distances $a_1$, $b_1$, $c_1$ and $d_1$ shown in FIG. 3*a* to distances $a_2$, $b_2$, $c_2$ and $d_2$ shown in FIG. 3*b* results from a displacement of the feeding device 10, 14 by rolling the roller card feeder 31 toward the roller card 1 (FIG. 1) in the direction of the arrow F. The swinging and shifting motions of the rolls will be described in further detail with reference to FIGS. 4*a*, 4*b*, 4*c* and 5*a*, 5*b*, 5*c* which relate to the two embodiments shown in FIG. 2 and in FIGS. 3*a*, 3*b*, respectively.

Figure 4A:
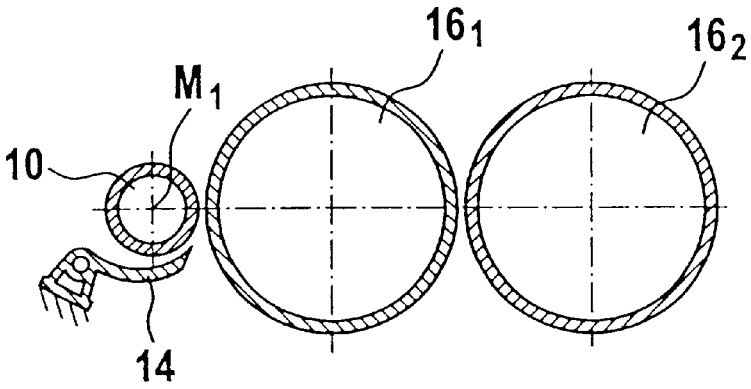
FIGS. 4*a,* 4*b* and 4*c* are schematic side elevational views showing initial, intermediate and end positions of the pivotal opening roll of the FIG. 2 embodiment.
Figure 4B:
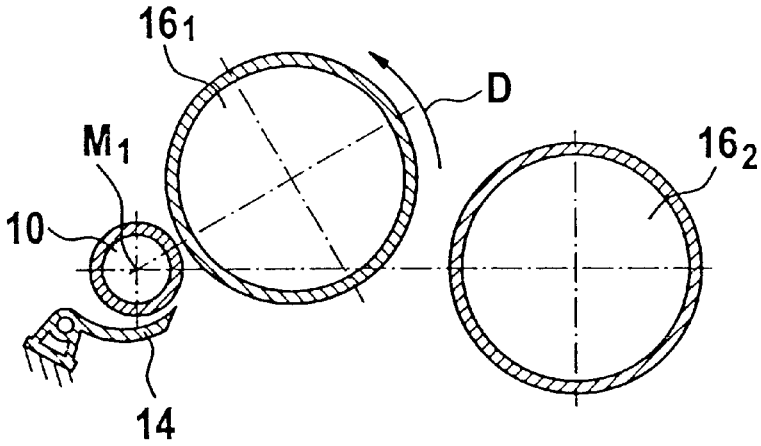
Figure 4C:
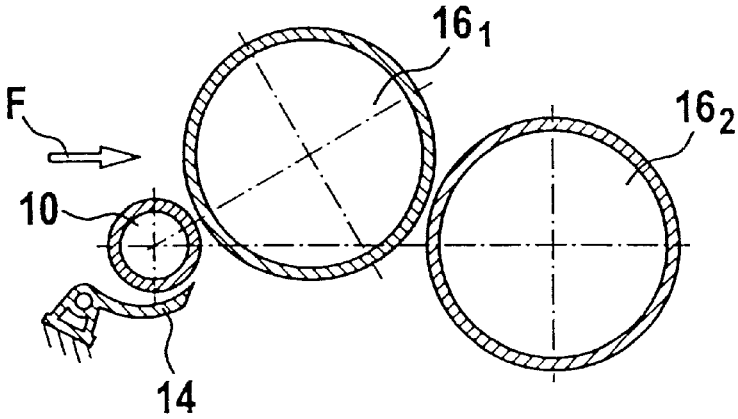

In FIGS. 4*a*, 4*b* and 4*c* the preliminary roll $\mathbf{16}_1$ is arcuately displaceable about the axis $M_1$ of the feed roll 10 as shown in FIG. 2. FIG. 4*a* shows the starting position of the feeding device (feed roll 10 and feed tray 14) and the preliminary rolls $\mathbf{16}_1$ and $\mathbf{16}_2$ (in FIG. 2 the preliminary roll $\mathbf{16}_2$ was omitted). In a first step, according to FIG. 4*b*, the preliminary roll $\mathbf{16}_1$ is swung in the direction D about the axis $M_1$ of the feed roll 10. As a result, the distance between the clothings of the preliminary rolls $\mathbf{16}_1$ and $\mathbf{16}_2$ and the distance between the clamping and transfer locations defined by the feeding device 10, 14 and the roll $\mathbf{16}_1$ rolls increases. In order to reestablish the required initial distance between the clothings of the preliminary rolls $\mathbf{16}_1$ and $\mathbf{16}_2$ shown in FIG. 4*a*, in a second step according to FIG. 4*c*, the feeding device 10, 14 is, together with the preliminary roll $\mathbf{16}_1$, shifted in the direction F toward the preliminary roll $\mathbf{16}_2$ by rolling the feeder 31 toward the roller card 1 as noted earlier. As a result, the distance between the clamping location defined by the feed roll 10 and the feed tray 14 and the transfer location defined by the feed roll 10 and the preliminary roll $\mathbf{16}_1$ is enlarged, while the distance between the rolls 10 and $\mathbf{16}_1$ and between the rolls $\mathbf{16}_1$ and $\mathbf{16}_2$ remains the same, as may be seen by a comparison between FIGS. 4*a* and 4*c*.

Figure 5A:
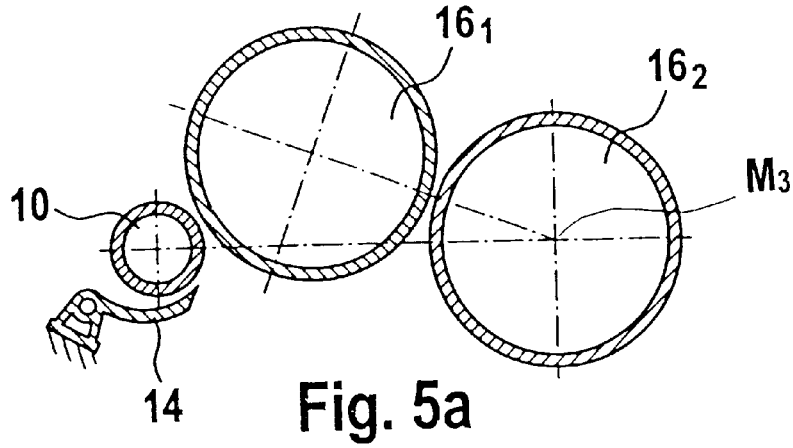
FIGS. 5*a,* 5*b* and 5*c* are schematic side elevational views showing initial, intermediate and end positions of the pivotal opening roll of the embodiment shown in FIGS. 3*a,* 3*b*.
Figure 5B:
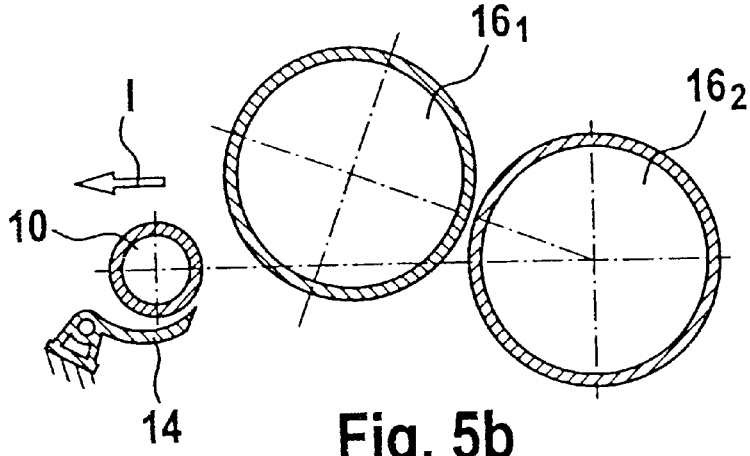
Figure 5C:
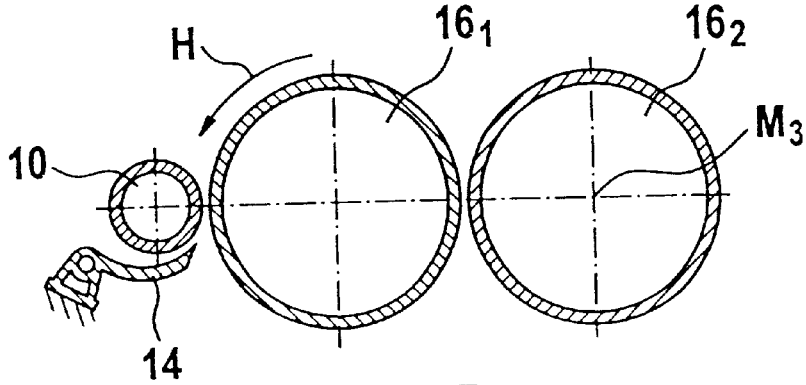

In FIGS. 5*a*, 5*b* and 5*c* an arcuate displacement of the preliminary roll $\mathbf{16}_1$ about the axis $M_3$ of the preliminary roll $\mathbf{16}_2$ is shown in accordance with the embodiment illustrated in FIGS. 3*a* and 3*b*. In FIG. 5*a* the initial position of the feeding device (feed roll 10, and feed tray 14), the preliminary roll $\mathbf{16}_1$ and the preliminary roll $\mathbf{16}_2$ is shown. In a first step according to FIG. 5*b*, the feeding device 10, 14 is shifted in the direction of the arrow I away from the preliminary roll $\mathbf{16}_1$ by rolling the feeder 31 away from the roller card 1 (FIG. 1). As a result, the distance between the clothings of the feed roll 10 and the preliminary roll $\mathbf{16}_1$ is increased. In order to reestablish the required initial distance between the feed roll 10 and the preliminary roll $\mathbf{16}_1$ according to FIG. 5*a*, in a second step according to FIG. 5*c* the preliminary roll $\mathbf{16}_1$ is swung in the direction of the arrow H about the axis $M_3$ of the preliminary roll $\mathbf{16}_2$. In this manner, the distance between the clamping location defined by the feed roll 10 and the feed tray 14 and the transfer location defined between the feed roll 10 and the preliminary roll $\mathbf{16}_1$ is reduced as compared to that shown in FIG. 5*a* and also, the distance between the two rolls 10 and $\mathbf{16}_1$ is re-established.

While in the preceding description the invention was set forth in connection with a roller card and roller card feeder, it will be understood that in the same manner a mobile card feeder (incorporating the feeding device 10, 14) and a carding machine may be used.

Figure 6:
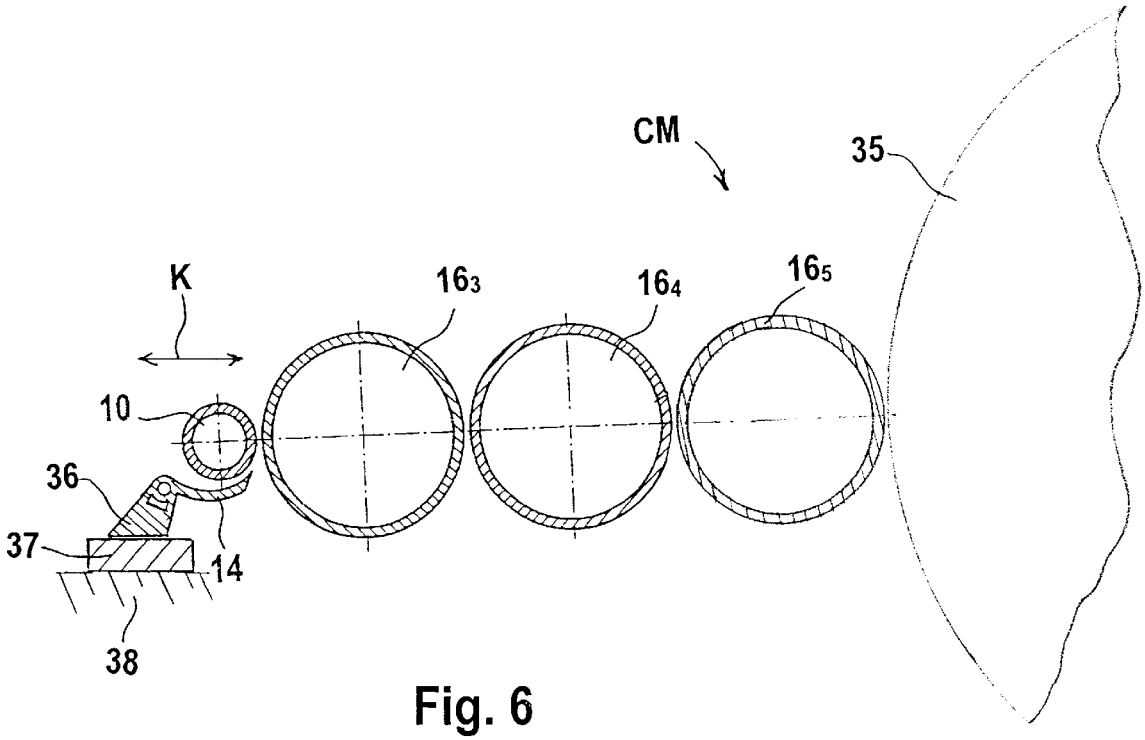
FIG. 6 is a schematic partial view of a carding machine incorporating another preferred embodiment of the invention.

FIG. 6 shows an embodiment in which the feeding device 10, 14 is an integral part of the fiber processing machine, such as a schematically and partially shown carding machine CM. The feeding device 10, 14 is followed by three licker-ins $\mathbf{16}_3$, $\mathbf{16}_4$ and $\mathbf{16}_5$. The feeding device 10, 14 receives the fiber tufts as a fiber batt from, for example, a non-illustrated card feeder and advances the fiber material to the licker-in $\mathbf{16}_3$. The fiber material is then consecutively transferred to the licker-ins $\mathbf{16}_4$ and $\mathbf{16}_5$ and the latter transfers the fiber material to the main carding cylinder 35. For varying, according to the invention, the distance between the clamping location defined by the feed roll 10 and the feed tray 14 and the transfer location at the licker-in $\mathbf{16}_3$, the latter may be swung either about the rotary axis of the feed roll 14 as described in connection with FIGS. 2, 4*a*, 4*b* and 4*c* or about the licker-in $\mathbf{16}_4$ as described in connection with FIGS. 3*a*, 3*b*, 5*a*, 5*b* and 5*c*. For the required shifting of at least the feeding device 10, 14 in the direction of the arrow K, the feeding device 10, 14 is mounted on a support block 36 which may be displaced on a base block 37 which, in turn, is stationarily secured to the card frame 38.

It will be understood that the above description of the present invention is susceptible to various modifications, changes and adaptations, and the same are intended to be comprehended within the meaning and range of equivalents of the appended claims.

What is claimed is:

1. A fiber processing system comprising (a) a first roll having a rotary axis;

(b) a feed tray defining a clamping location with said first roll for clamping and advancing fiber material; said first roll and said feed tray together forming a feeding device;

(c) a second roll having a rotary axis and cooperating with said feeding device for taking over the fiber material therefrom at a transfer location on said second roll;

(d) a third roll having a rotary axis and cooperating with said second roll for taking over the fiber material from said second roll; and (e) adjusting means for varying a distance between said clamping and transfer locations; said adjusting means including (1) pivot means for arcuately displacing said second roll about the rotary axis of one of said first and third rolls; and (2) shifting means for displacing said feeding device toward or away from said third roll.

2. The fiber processing system as defined in claim 1, wherein said pivot means for arcuately displacing said second roll about the rotary axis of said third roll comprises a coupling member connecting said second roll with said third roll.

3. The fiber processing system as defined in claim 2, wherein said means for arcuately displacing said second roll about the rotary axis of said first roll comprises a coupling member connecting said second roll with said first roll, whereby said shifting means is adapted to displace said second roll together with said feeding device.

4. The fiber processing system as defined in claim 1, comprising a first unit and a second unit; said first unit being a fiber batt feeder including said feeding device; said second unit being one of a carding machine and a roller card including said second and third rolls; said first unit including said shifting means for displacing said first unit relative to said second unit.

5. The fiber processing system as defined in claim 4, wherein said shifting means comprises wheels for rolling said first unit on a floor toward or away from said second unit.

6. The fiber processing system as defined in claim 1, comprising a first unit and a second unit; said first unit being a fiber batt feeder including said feeding device and said second roll; said second unit being one of a carding machine and a roller card unit including said third roll; said first unit including said shifting means for displacing said first unit relative to said second unit.

7. The fiber processing system as defined in claim 6, wherein said shifting means comprises wheels for rolling said first unit on a floor toward or away from said second unit.

8. The fiber processing system as defined in claim 1, including a fiber processing machine; said feeding device, said second roll and said third roll being integrated in said fiber processing machine; said shifting means including means for providing for a displacement of said feeding device within said fiber processing machine toward or away from said third roll.

9. The fiber processing system as defined in claim 8, wherein said means for providing for a displacement comprises a support block carrying said feeding device and a base block stationarily mounted in said fiber processing machine; said support block being displaceably mounted on said base block.

10. The fiber processing system as defined in claim 8, wherein said fiber processing machine is a carding machine.

* * * * *